US008302915B2

(12) United States Patent
Biagiotti

(10) Patent No.: US 8,302,915 B2
(45) Date of Patent: Nov. 6, 2012

(54) HYDRAULIC MOTOR FOR RAILWAY SWITCHES

(75) Inventor: Maurizio Biagiotti, Pisa (IT)

(73) Assignee: General Electric Company, Schenectady, NY (US)

( * ) Notice: Subject to any disclaimer, the term of this patent is extended or adjusted under 35 U.S.C. 154(b) by 453 days.

(21) Appl. No.: 12/374,432

(22) PCT Filed: Jul. 17, 2007

(86) PCT No.: PCT/US2007/073675

§ 371 (c)(1), (2), (4) Date: Jan. 20, 2009

(87) PCT Pub. No.: WO2008/027662

PCT Pub. Date: Mar. 6, 2008

(65) Prior Publication Data

US 2009/0308986 A1 Dec. 17, 2009

(30) Foreign Application Priority Data

Aug. 28, 2006 (IT) ..... MI2006A1647

(51) Int. Cl.
*B61L 5/04* (2006.01)

(52) U.S. Cl. ..... 246/257; 246/415 R

(58) Field of Classification Search ..... 246/93, 246/100, 116, 139, 257–261, 271, 361, 415 R
See application file for complete search history.

(56) References Cited

U.S. PATENT DOCUMENTS 4,213,588 A 7/1980 Bowles

FOREIGN PATENT DOCUMENTS

| | | | |
|---|---|---|---|
| CH | 520009 | A | 3/1972 |
| DE | 3916696 | A1 | 12/1989 |
| EP | 0778191 | A | 6/1997 |
| FR | 2379415 | A | 9/1978 |
| FR | 2442750 | A | 6/1980 |

*Primary Examiner* — S. Joseph Morano
*Assistant Examiner* — Zachary Kuhfuss
(74) *Attorney, Agent, or Firm* — GE Global Patent Operation; John A. Kramer

(57) ABSTRACT

A control mechanism for a railroad switch machine, the mechanism including a hydraulic circuit operable to move a rail end point of a switch point assembly of the railroad switch machine, a pump to hydraulically operate the hydraulic circuit, and a motor to operate the pump, wherein the only electromechanical parts of the control mechanism are within the motor.

18 Claims, 2 Drawing Sheets

HYDRAULIC MOTOR FOR RAILWAY SWITCHES

FIELD OF THE INVENTION

The present invention relates to railway switching machines and, in particular, to an apparatus which is used to control and drive the moving of the rail end points of switch point assemblies.

BACKGROUND OF THE INVENTION

As is commonly known, railway switch point assemblies include two rail end points which are tapered rail profiles capable of deflecting to move between two different positions in order to facilitate the correct alignment of the track components for the desired path of rolling stock transiting through the switch point assembly. The switch point assembly has two deflectable or movable rail end points which move in concert with one another between first and second alternative positions. In a first alternative position, a first one of these movable rail end points can be aligned with a first fixed stock rail to facilitate passage of the rolling stock straight through the switch point onto a first set of fixed rails. In a second alternative position, the second movable rail end point can be aligned with a second fixed stock rail to facilitate passage of the rolling stock onto a second set of fixed rails, such as to divert the rolling stock onto a siding. The remote ends of the two deflectable rails almost intersect near the location where the second set of fixed rails diverges from the first set of fixed rails.

Such a device is described in Italian Patent No. IT1246656. The device described in that patent operates switch points which are independent, or disconnected, from each other, and it is not applicable to the problem of operating switch points of the interconnected type, i.e., of switch points connected to each other by transverse bars. Switch machines of the interconnected type are shown, for example, in U.S. Pat. Nos. 5,806,809, 6,149,106, and 6,691,958.

In a typical switch point assembly, the two deflectable rail end points are moved by rods protruding from the opposite extremities of a unit often called the switch point machine. Inside the switch point machine, the rods are usually connected to a device with a reciprocating straight line motion, which is powered by a motor unit which is generally placed to the side of the rails. The state of the art includes numerous switch point machines for railway split point movements. Such mechanisms are normally installed at the switch point, and they are typically applied only to move the split rail end points of the switch point assembly.

The mechanism is used either to move the deflectable rail end points of the switch point assembly or to move the deflectable V-point of a movable point frog assembly. The mechanisms are electromechanical systems.

BRIEF DESCRIPTION OF THE INVENTION

The present invention is directed to an apparatus that is used to control and drive the moving of the rail end points of switch point assemblies. Towards this end, a control mechanism for a railroad switch machine is disclosed. The mechanism has a hydraulic circuit. The hydraulic circuit is operable to move a rail end point of a switch point assembly of the railroad switch machine. A pump to hydraulically operate the hydraulic circuit, and a motor to operate the pump are also provided. The only electromechanical parts of the control mechanism are within the motor.

In another exemplary embodiment, a mechanism comprising a hydraulic circuit, and having no electromechanical components, operable to move a rail end point wherein pressure to operate the hydraulic circuit is provided by a pump powered by a motor is disclosed for use in a railroad switch machine having a switch point assembly with a rail end point a control mechanism for moving the rail end point.

In yet another exemplary embodiment, a method for operating a railroad switch machine having a switch point assembly with a rail end point utilizing no electromechanical parts is disclosed. The method comprises providing a liquid material in an enclosed transport chamber where the transport chamber is in communication with an actuator. Placing the liquid under pressure so as to move the liquid material through the transport chamber is also disclosed. Activating the actuator with the liquid material so as to move the rail end point is also disclosed.

BRIEF DESCRIPTION OF THE DRAWINGS

A more particular description of the invention briefly described above will be rendered by reference to specific embodiments thereof that are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE INVENTION

With reference to the figures, exemplary embodiments of the invention will now be described. The present invention is disclosed below specific to a pivoting connector. The scope of the present invention is not limited to a pivoting connector within a switch machine. Specifically, the present invention may be implemented in association with other moving parts of a switch machine.

Present systems used to control and drive the moving of the rail end points of switch point assemblies are mainly electromechanical. These systems employ components, such as high current relays, contactors, pressure switches and others, which are particularly sensitive to environmental or ambient, conditions, such as but not limited to temperature, humidity and mechanical stress, which can be extreme in railway applications. Railway applications would greatly benefit from control systems and actuators that can offer a higher mean time between failure (MTBF) and can be implemented with devices and components which are adapted to work correctly in the presence of the most severe ambient conditions.

Figure 1:
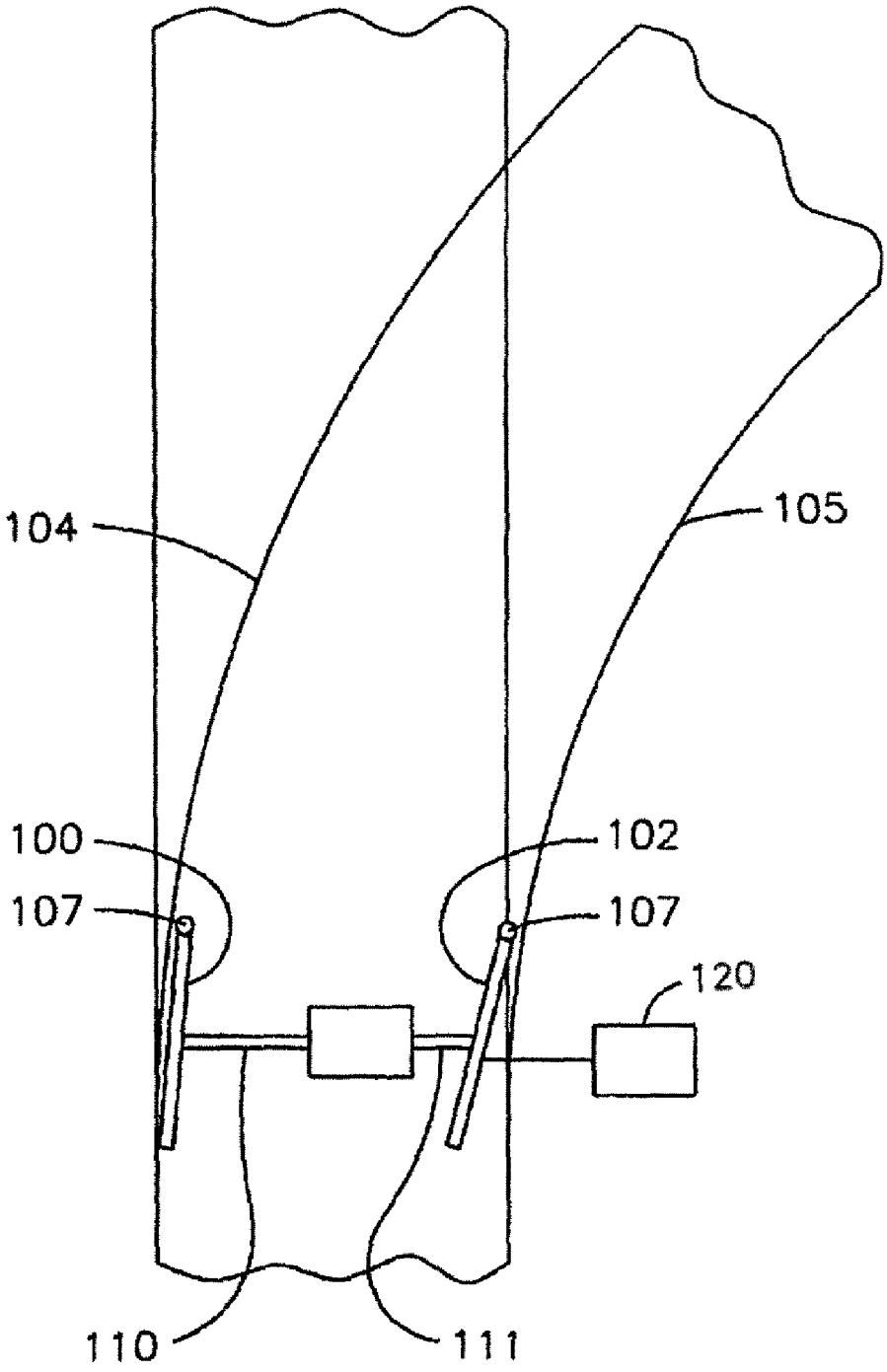
FIG. 1 PRIOR ART
FIG. 1 depicts a top view illustration of a railway switch.

FIG. 1 depicts a top view illustration of a railway switch. Each switch point 100, 102, along with the respective section of rail 104, 105 to which it is attached, pivots around an axis, such as the axis 107 when the switch point is moved. However, it should be noted that the pivot radius of the rail is relatively large compared to the dimensions of the other elements shown in FIG. 1, and thus the location of the axis 107 is not shown to scale. As the operating rod 110, 111 moves longitudinally to move its associated switch point 100, 102 laterally, it can be seen that the angle will change slightly. A motor mechanism 120 is proximate the switch points so as to operate their movement. Though illustrated as being outside of the rails, in another exemplary embodiment the motor mechanism 120 may be located within the rails.

Figure 2:
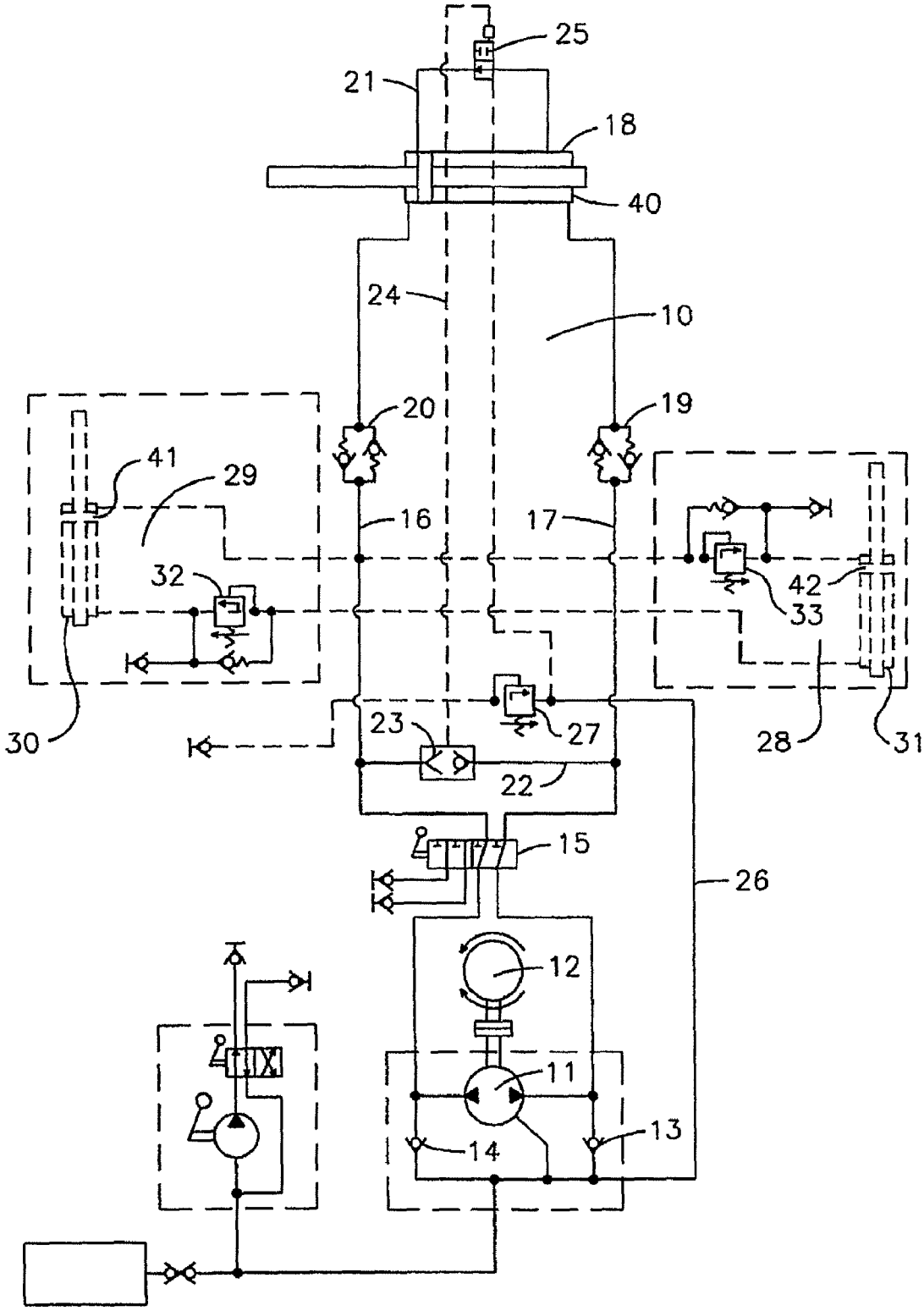
FIG. 2 depicts a schematic of an exemplary embodiment of a hydraulic control system for switch point assemblies according to the present invention.

FIG. 2 depicts a schematic of an exemplary embodiment of a hydraulic control system for switch point assemblies according to the present invention that would be located within the motor mechanism 120. A hydraulic circuit 10 is supplied by a pump 11 that is driven by a suitable electric motor 12. The motor 12 is operable in clockwise and counter-clockwise rotation. The pump is capable of alternatively feeding pressure to lines A and B of the system. The pump 11 is associated with a pair of unidirectional valves 13, 14. A switch 15 allows for connecting and/or disconnecting the pump 11 from the hydraulic circuit 10 in order to activate, respectively, automatic or manual operation of the system according to the present invention.

Two main branches 16, 17 of the hydraulic circuit 10 supply an actuator 40, which consist of one or more hydraulic cylinder(s) 18, through a pair of bi-directional valves 19, 20. The hydraulic cylinder 18 is provided with a bypass circuit 21 comprising a by-pass valve 25 that is aimed to let one or more hydraulic cylinder(s) 18 provide a low resistive force during reverse motion of the rail end point (trailing phase), and may be also be used to "wash" the hydraulic cylinder 18 itself and change the oil in the whole hydraulic circuit 10.

The two main branches 16, 17 of the hydraulic circuit 10 are connected by a third branch 22 which is divided in two by a commutation valve 23 connected also to the by-pass valve 25 which is further connected to a fifth branch 26 of the hydraulic circuit 10, which is connected, in turn, to the pair of unidirectional valves 13, 14. The fourth branch 24 and a fifth branch 26 of the hydraulic circuit 10 are connected through a maximum pressure valve 27.

In an exemplary embodiment, the first two branches 16, 17 of the hydraulic circuit 10 are connected to two sub circuits 28, 29 adapted to operate the actuators 41, 42 that control the electrical contactors of the electric motor 12 that drive the pump 11. Each of the sub circuits 28, 29 comprises a hydraulic cylinder 30, 31 and a maximum pressure valve 32, 33. The hydraulic cylinders 30, 31 function so as to enable the pump motor 12 to operate the maneuvering of the rail end points, and then to disconnect the motor 12 when the rail end point has reached its final position. The sub circuits 28, 29 are needed when the rail end points are not provided with an automatic remote management of the pump motor 12 capable of disconnecting the motor 12 when it is needed.

As further depicted in FIG. 1, the pump 11 pushes the oil towards the first branch 16 of the hydraulic circuit 10 to which the pump 11 is connected through the switch 15. The oil flows first towards the by-pass valve 25 and then towards the first of the sub circuits 29 filling the hydraulic cylinder 30 up and towards the fourth branch 24 since the commutation valve 23 is closed at this stage.

After a predetermined delay, when its threshold pressure is reached, the bidirectional valve 20 opens up and delivers fluid towards the main cylinder 18, thus moving its piston to its opposite limit position. The load offered by the piston during this phase is very low. When the main hydraulic cylinder 18 is completely filled up and its piston has reached its limit position, then the maximum pressure valve 33, characterized by a lower limit pressure with respect to the valve 27, opens up and lets the fluid flow towards the second of the sub circuit 28 starting to fill the hydraulic cylinder 31 up.

After a predetermined delay, when the maximum pressure valve 27 reaches its threshold pressure, it opens up and lets the oil flow through the fifth branch 26 of the hydraulic circuit, thus releasing the pressure of branch 24. Once completed, the system is ready to start again when the next maneuver of the rail end point is required.

In the present invention, it is possible to control the motor 12 by way of a remote control room, facility, and/or depot, 50. Towards this end, the remote control room may be in wireless and/or in wired communication with the motor. The control emanating from the remote facility may be electronically initiated or manually initiated. Electronically initiated means that software or an automated controller makes a determination as to whether activation is required.

In another exemplary embodiment, the present invention can be viewed as the circuit 10 having an enclosed transport chamber 16, 17 with a liquid material within it that is in communication with an actuator 40. The liquid material is under pressure so as to move the liquid through the transport chamber. The liquid material would then activate the actuator 40 so as to move the rail end point. The motor 12 and pump 11 are in communication with the transport chamber so as to provide pressure to move the liquid material. The liquid material is a hydraulic-based oil. Subsets of the transport chamber 28, 29 are in communication with second actuators 41, 42 that are operable to control the motor 12.

Thus, the present invention provides a system for controlling and driving the moving of the rail end points of switch point assemblies that is completely hydraulic, thus minimizing the number of electromechanical parts and components and related wiring and electrical supply and management. The only electromechanical components, or parts, may be located in the motor 12, and/or switch 15. The system can be either remotely or locally controlled thus allowing for easy backup when fault conditions or need for maintenance occurs. In detail, in an exemplary embodiment of the present invention the system is provided with the possibility of being operated manually through a switch that bypasses the pump and its driver motor. Moreover, it can be equipped with two additional sub-systems that disconnect the pump motor when the actuator has reached its limit position after the rail end point has been commuted. The present invention is also able to provide a system for controlling and driving the rail end points of switch point assemblies which minimizes the offered load to the train during the trailing phase thus reducing the design constraints to guarantee reliable operations even during the trailing phase itself.

While the invention has been described in what is presently considered to be a preferred embodiment, many variations and modifications will become apparent to those skilled in the art. Accordingly, it is intended that the invention not be limited to the specific illustrative embodiment but be interpreted within the full spirit and scope of the appended claims.

What is claimed is:

1. A control mechanism for a railroad switch machine, the mechanism comprising:

a hydraulic circuit operable to move a rail end point of a switch point assembly of the railroad switch machine;

a pump to hydraulically operate the hydraulic circuit;

a motor to operate the pump; and a pressure valve to disconnect the motor when the rail end point has reached a designated position, wherein the hydraulic circuit comprises:

a first sub circuit comprising a first hydraulic cylinder; and a second sub circuit comprising a second hydraulic cylinder, wherein the first hydraulic cylinder and the second hydraulic cylinder enable the pressure valve to disconnect the motor after the rail end point has reached the designated position.

2. The control mechanism of claim 1 wherein the hydraulic circuit comprises a first actuator to move the rail end point.

3. The control mechanism of claim 1 wherein the motor is operable in a clockwise and counter-clockwise rotation.

4. The control mechanism of claim 1 wherein the motor is controlled from a remote location, and wherein the remote location is in wireless communication with the motor.

5. The control mechanism of claim 2 further comprising a second actuator operable to control the motor, and a hydraulic sub circuit to operate the second actuator, wherein the hydraulic sub circuit is operable to control the motor.

6. A control mechanism for a railroad switch machine, the mechanism comprising:

a hydraulic circuit operable to move a rail end point of a switch point assembly of the railroad switch machine;

a pump to hydraulically operate the hydraulic circuit;

a motor to operate the pump;

a pressure valve to disconnect the motor when the rail point has reached a designated position, and a switch so that the pump and motor are bypassed, wherein the switch is configured to connect or disconnect the pump from the hydraulic circuit to permit activation between automatic and manual operation.

7. A control mechanism for moving a rail end point of a railroad switch machine switch point assembly, the mechanism comprising:

a hydraulic circuit operable to move the rail end point; and a pump powered by a motor for providing pressure for operation of the hydraulic circuit, wherein the hydraulic circuit comprises:

a first sub circuit corn rising a first hydraulic cylinder;

a second sub circuit comprising a second hydraulic cylinder; and a pressure valve, wherein the first hydraulic cylinder and the second hydraulic cylinder enable the pressure valve to disconnect the motor when the rail end point has reached a designated position.

8. The mechanism of claim 7 wherein the hydraulic circuit comprises a first actuator to move the rail end point.

9. The mechanism of claim 8 wherein the hydraulic circuit further comprises a second actuator operable to control the motor, and a hydraulic sub circuit to operate the second actuator.

10. The mechanism of claim 9 wherein the hydraulic sub circuit is operable to control the motor.

11. The mechanism of claim 7 herein the motor is operable in a clockwise and counter-clockwise rotation.

12. The mechanism of claim 7 wherein the motor is controlled from a remote location, and wherein the remote location is in wireless communication with the motor.

13. A control mechanism for moving a rail end point of a railroad switch machine switch point assembly, the mechanism comprising:

a hydraulic circuit operable to move the rail end point;

a pump powered by a motor for providing pressure for operation of the hydraulic circuit, wherein the hydraulic circuit comprises a pressure valve so as to disconnect the motor when the rail end point has reached a designated position; and a switch in communication with the motor and pump so that the pump and motor may be bypassed, wherein the switch is configured to connect or disconnect the pump from the hydraulic circuit to permit activation between automatic and manual operation.

14. A method for operating a railroad switch machine having a switch point assembly with a rail end point, the method comprising:

pressuring a liquid material in an enclosed transport chamber, where the transport chamber includes a first sub circuit comprising a first hydraulic cylinder and a second sub circuit comprising a second hydraulic cylinder, the first sub circuit and the second sub circuit being in communication with an actuator, so as to move the liquid material through the transport chamber, wherein pressure for pressuring the liquid material is provided by a motor and pump in communication with the transport chamber; and activating the actuator with the liquid material so as to move the rail end point, wherein the first hydraulic cylinder and the second hydraulic cylinder enable the motor to be disconnected when the rail end point has reached a designated position.

15. The method of claim 14 wherein the liquid material is a hydraulic-based oil.

16. The method of claim 14 further comprising controlling the motor with a second actuator in communication with a subset of the transport chamber.

17. The method of claim 14 further comprising controlling the motor from a remote facility.

18. A control mechanism for moving a rail end point of a railroad switch machine switch point assembly, the mechanism comprising:

a motor:

a hydraulic circuit operable to move the rail end point;

a pump powered by the motor for providing pressure for operation of the hydraulic circuit, wherein the hydraulic circuit comprises a pressure valve so as to disconnect the motor when the rail end point has reached a position; and a switch configured to connect or disconnect the pump from the hydraulic circuit to permit activation between automatic and manual operation, wherein the only electromechanical components in the control mechanism is one or both of the motor and the switch.

* * * * *